US011363880B2

(12) United States Patent
Dychtwald

(10) Patent No.: US 11,363,880 B2
(45) Date of Patent: Jun. 21, 2022

(54) MANUAL FORCE SENSITIVE TOOTHBRUSH

(71) Applicant: Scott Eric Dychtwald, Silver Spring, MD (US)

(72) Inventor: Scott Eric Dychtwald, Silver Spring, MD (US)

( * ) Notice: Subject to any disclaimer, the term of this patent is extended or adjusted under 35 U.S.C. 154(b) by 195 days.

(21) Appl. No.: 16/728,614

(22) Filed: Dec. 27, 2019

(65) Prior Publication Data

US 2021/0196039 A1 Jul. 1, 2021

(51) Int. Cl.

| | |
|---|---|
| ***A46B 5/00*** | (2006.01) |
| ***A46B 15/00*** | (2006.01) |
| ***A46B 9/04*** | (2006.01) |

(52) U.S. Cl.

CPC ..... *A46B 15/0012* (2013.01); *A46B 5/0041* (2013.01); *A46B 9/04* (2013.01); *A46B 15/0026* (2013.01); *A46B 15/0038* (2013.01); *A46B 2200/1066* (2013.01)

(58) Field of Classification Search

CPC ..... A46B 15/0038; A46B 15/0026; A46B 15/0012; A46B 5/0041

See application file for complete search history.

(56) References Cited

U.S. PATENT DOCUMENTS 2,429,740 A * 10/1947 Aufsesser ..... A46B 9/04 15/167.1
5,355,544 A * 10/1994 Dirksing ..... A46B 15/0002 15/105
6,327,734 B1 * 12/2001 Meginniss, III ... A46B 15/0002 15/105

FOREIGN PATENT DOCUMENTS

CN 204015488 U * 12/2014
JP 2001299451 A * 10/2001 ..... A46B 15/0012

* cited by examiner

*Primary Examiner* — Daniel J Colilla
(74) *Attorney, Agent, or Firm* — Royal W. Craig; Gordon Feinblatt LLC

(57) ABSTRACT

A Manual Force Sensitive Toothbrush which includes a pivot section which couples a main beam section to a bristle beam section. The pivot section provides notification to user when force upon gumline is exceeded beyond the predetermined levels of force. The pivot is a manual system the connects and reconnects through the use of magnets. When magnets are in connect, the main beam and bristle beam sections provide the end user a gripping section and bristle section to carefully and effectively brush tooth and gums, adversely the force sensitive toothbrush releases upon excessive force applied against tooth and gum—creating a force sensitive section in the toothbrush as referred to as the pivot section. The release of the bristle beam section extends between 15-20 degrees from the resting plane of the main beam section. As further use, the bristle beam section bristle head backside has a thoughtfully designed indent for the use to apply an index finger to stabilize the main beam section with the bristle beam section to brush the tongue with ability to apply forces above that designed for the tooth and gum.

4 Claims, 9 Drawing Sheets

MANUAL FORCE SENSITIVE TOOTHBRUSH

BACKGROUND

Development due for the need to mitigate exasperation and receding of the gumline thru excessive force applied to the gumline. Though receding gumlines can be through heredity, controlling the levels of force in the brushing process will assist in the resolution of gum line exasperation. Maintaining a design and functionality within keeping a manual toothbrush that is cost effective. Corrective and directive instructions to properly use for both adults and adolescents has the primary goal with a secondary goal to provide individuals to safely and comfortably brush teeth without further pain or exasperation of the gumline

BRIEF DESCRIPTION OF THE FIGURES

The invention and the following detailed description of certain embodiments thereof may be understood by reference to the following figures in which the element numbers refer to like elements.

DETAILED DESCRIPTION

All documents mentioned herein are incorporated in the entirety by reference in figures. References to the items in the singular should be understood to include items in the plural, and vice versa, unless explicitly stated otherwise or clear from the text. Grammatical occurrences are only intended to express any and all divisional and non-divisional combinations of conjoined clauses, sentences, words, and the like, unless otherwise stated or clear from the context. Thus, the term "or" should generally be understood to mean "and/or" and so forth.

Figure 1A:
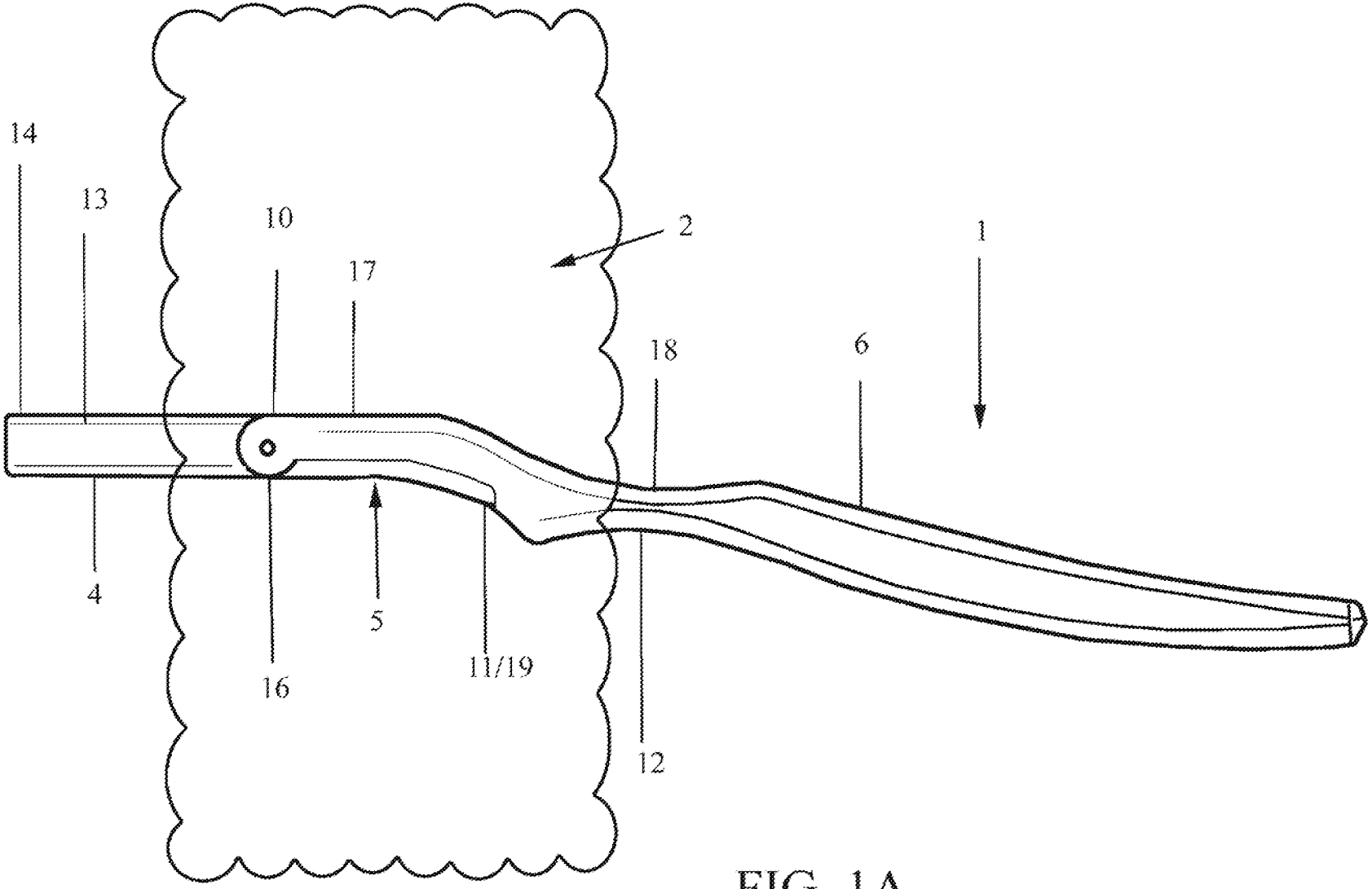
FIG. 1A is a side view of the force sensitive toothbrush

FIG. 1A is a sideview of a Manual Force Sensitive Toothbrush. The force sensitive toothbrush 1 may include a bristle beam section 5 and a Manual Force Sensitive Toothbrush region 2 that couples the bristle beam section 5 to a handle region 1, a main beam 6 in the handle region 1 may include any suitable ergonomic, gripping features such as indents for index finger 12 and the like with thumb grip 18. In use, the user grips handle 1 of main beam 6 and applies force and movement to the toothbrush in a brushing motion and a balance force of a number of bristles 4 on the bristle beam section 5 against the teeth and gum. As force is transmitted from the user's hand through the force sensitive toothbrush main beam 6 which includes the force sensitive pivot region 2, the force greater than the predetermined force will activate the force sensitive region 2 to disengage.

In general, the handle region 1 main beam 6 interacts with bristle head beam 5 and main beam point of pivot 16 of the force sensitive region 2 to change from state 1 to state 2 in response to an applied force on bristles 4 inserted onto the bristle beam section 5 against the teeth and gum that exceeds the pre-determined force. The return from state 2 to state 1 is controlled and coupled by the magnet 19 set in the bottom face of main beam 6 and the magnet 19 in the top face of bristle beam 5 in FIG. 2A.

In general, as the force sensitive toothbrush is in state 1, handle region 1 main beam 6 and bristle beam section 5 are held in contact through bristle beam section 5 magnet 11 and main beam section 6 magnet 19. Upon force being applied to bristle head beam region exceeds the predetermined force, the magnet 11 in bristle beam section 5 and magnet 19 in the main beam 6 release, causing pivot region 2 to motion away from handle region 1.

The handle region 1 pivot area 2 thickness is equal to main beam parallel arms in alignment with the bristle beam section 5. In one aspect, the pivot region 2 may be fabricated of a material and at a thickness such that it will not buckle or deform beyond the elastic zone under typical brushing force.

FIG. 1A in its entirety on a side view is the toothbrush handle section 1 with bristle beam 5 engaged at pivot area section 2. Similarly, it is understood the entire force sensitive toothbrush looks no different than an ordinary toothbrush other than the fact the pivot section 2 allows the bristle beam section to release when predetermined force causes magnet 11 from bristle beam section 5 to release from magnet 19 from main beam 6. This predetermined force causes the bristle beam 5 to pivot away from main beam 6 making a click noise for the user to audibly hear and the pivoting release for the user to feel. Bristle beam 5 section to pivot between 15-20 degrees from the toothbrush handle section 1. An integrated stop in the bristle beam limits the pivot between 15-20 degrees. Simply pushing the bristle beam section 5 to be back in alignment with main beam 6 and re-engaging magnet 11 in bristle beam section 5 back with magnet 19 in main beam with an audible click for the users to hear and a predetermined rigidity of the bristle beam section 5 with main beam 6 to feel.

FIG. 1A provides highlight of pivot section 2 to be detail functionality of pivot ability. Main beam 6 contains main beam point of pivot 16 with an area per FIG. 3A main beam parallel arms. More detailed of main beam parallel arms 17 per FIG. 3B. the main beam parallel arms contain main beam point of pivot 16 in which bristle beam section 5 provides feature 10 to engage into main beam point of pivot 16. The engagement of feature 10 slides into the area between main beam parallel arms 17. Bristle beam section 5 provides bristle beam protrusion 9 which guides bristle beam section 5 into alignment with main beam 6 into the main beam parallel arms 17 controlled. When predetermined force causes the release of bristle beam section 5 from main beam 6 through the loss of contact at bristle beam section 5 magnet 11 from main beam 6 magnet 19, the bristle beam protrusion 9 glides out of main beam parallel arms 17 while maintaining connection at main beam point of pivot 16 and bristle beam section 5 at feature 10.

Figure 1B:
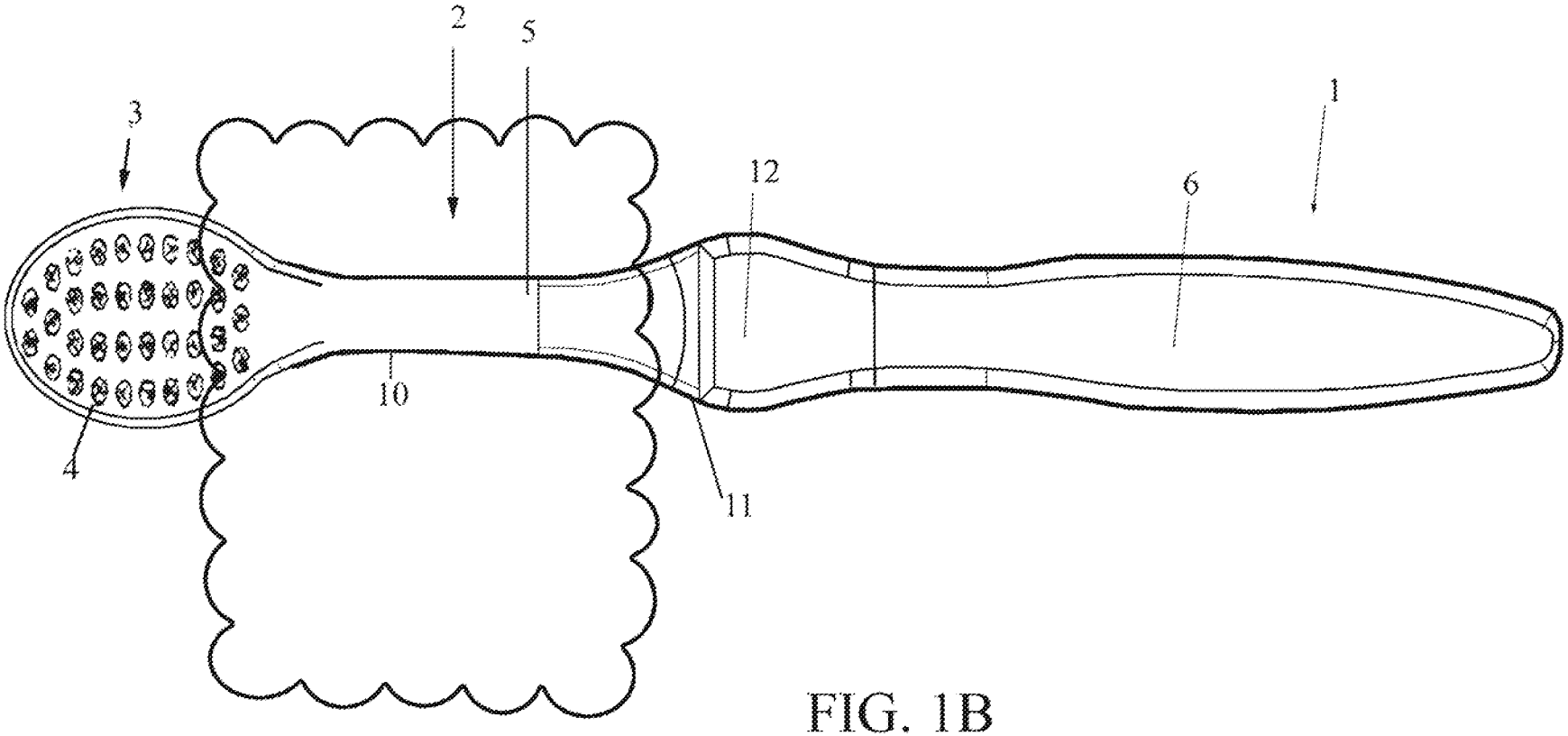
FIG. 1B is a top view of the force sensitive toothbrush

FIG. 1B provides a front view on the handle section 1 and the pivot section 2 in an engaged position whereas main beam 6 and bristle beam section 5 are in contact at bristle beam section 5 magnet 11 and main beam 6 magnet 19

FIG. 1A includes a thumb section 18 to provide an area for the thumb to grip in opposite force and controllability to pointer finger area 12 per FIG. 1A and FIG. 1B. This control allows the user to wrap remainder of fingers and hand around main beam 6. This holding ability gives the user greater control of the force sensitive toothbrush.

Figure 1C:
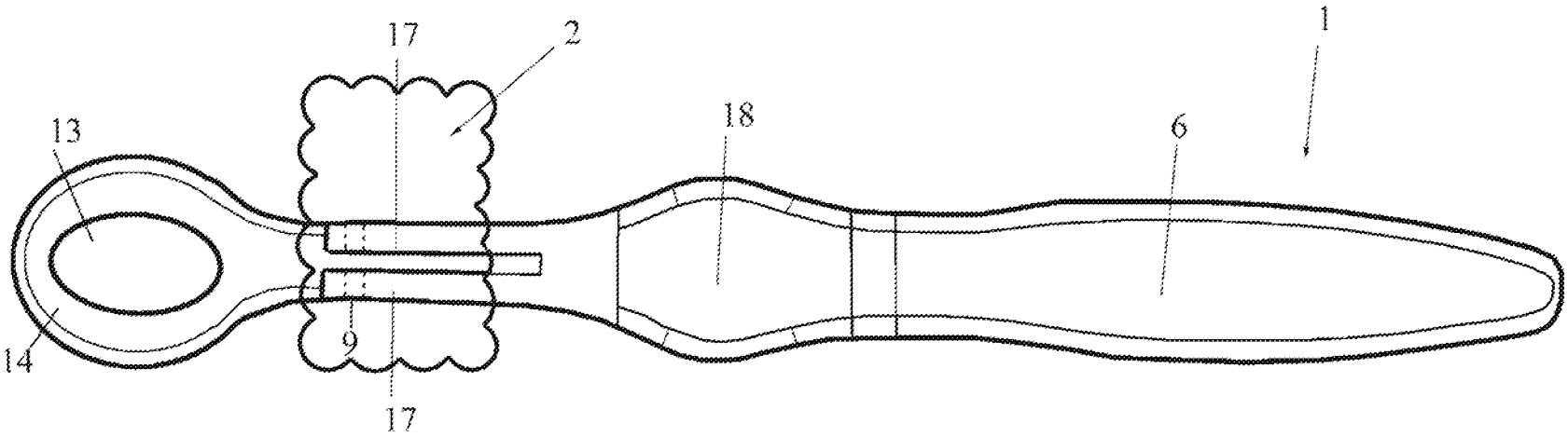
FIG. 1C is a bottom view of the force sensitive toothbrush

FIG. 1C provides bottom view to better detail the main beam parallel arms 17 as it attaches to feature 10. Main beam parallel arms 17 end at main beam point of pivot 16. Main beam point of pivot 16 surrounds the bristle mean section 5 main beam feature 10. The bristle beam section is guided in to main beam parallel arms 17 through the use of the bristle beam protrusion 9 on bristle beam section 5. The connection provides full range of motion for pivot section 2.

Figure 2A:
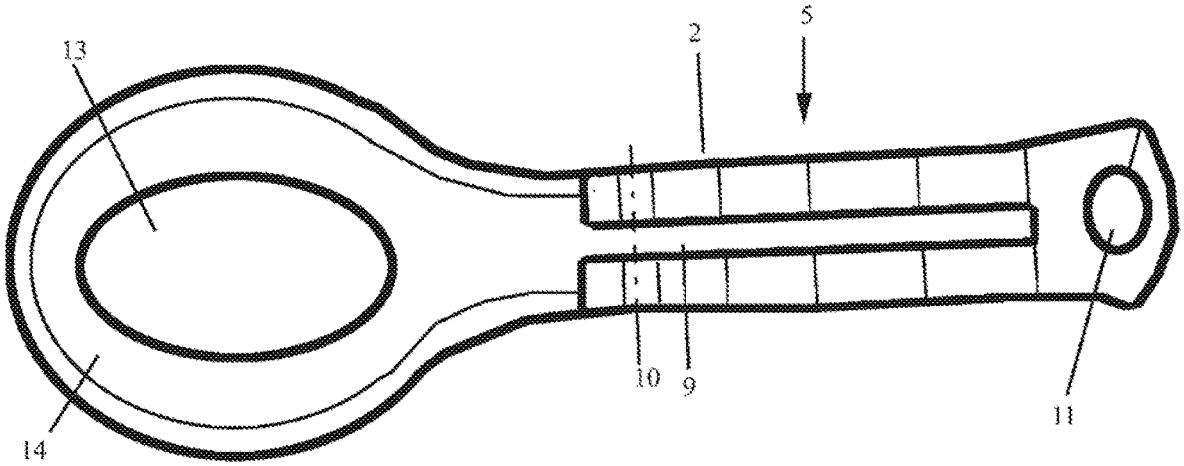
FIG. 2A is a bottom view of the head section of the force sensitive toothbrush

FIG. 2A In the bristle head beam section 3, it is inclusive of the bristle head 7. The bristle head encompasses a flat ring section 14 around the bristle head 7. Flat ring section 14 to allow flat surface fore bristling process versus a curved head. Flat ring section 14 surrounds concave section 13. Concave section 13 is a recess in the bristle head to provide index finger placement. Index finger depressing concave section 13 limits pivot ability at pivot area 2. The pivot area 2 encompasses feature 10 on the bristle head beam section 3 and the pivot ring 16 on FIG. 1A force sensitive toothbrush handle 1. Limiting the ability of pivot keeps bristle head section 3 in-line with force sensitive toothbrush handle 1 to provide user to brush tongue with increased Newtons with bristle head beam 3 bristles.

FIG. 2A in the bristle head beam section 3 encompasses magnet 11 at base. Magnet 11 has a diameter of 3.30+/−0.1 mm. The magnet 11 in bristle head beam section 3 corresponds to FIG. 1B Force Sensitive Toothbrush handle section 1 magnet 19. Magnet 19 in contact with magnet 11 when bristlehead beam section is in-line with force sensitive toothbrush handle section 1. In this position, the magnet 19 and magnet 11 engage with a release force of 1+/−0.5 Newtons. When force exceeds predetermined Newton level, Magnet 11 in bristle head beam section 3 disengages with magnet 19 in force sensitive toothbrush handle section 1.

Figure 2B:
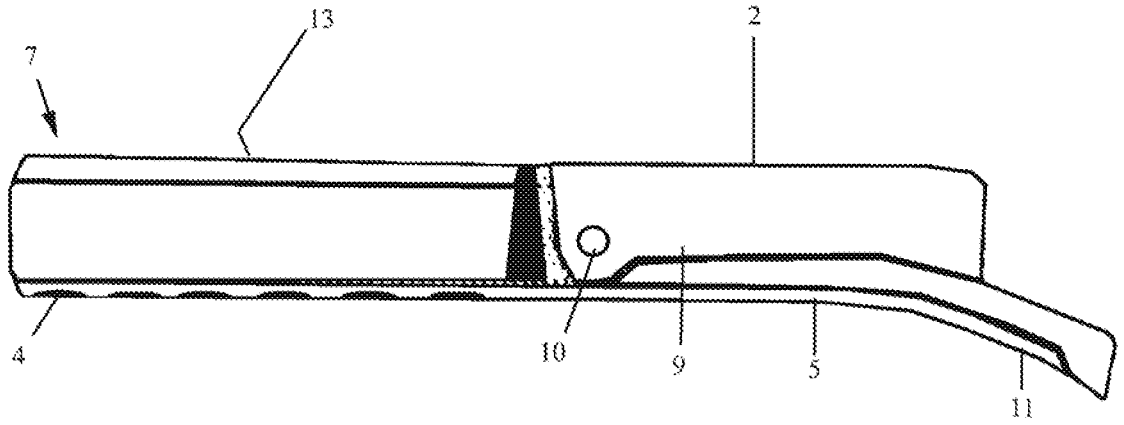
FIG. 2B is a side view of the head section of the force sensitive toothbrush

In general, FIG. 2A and FIG. 2B detail the functionality of engaging with FIG. 1A and FIG. 1B. Bristle beam protrusion section 9 engaged in the reciprocating main beam point of pivot 16 when bristle head beam section 5 is in-line with handle main beam 6.

FIG. 2B is comprised of a side view of bristle beam section 5. Feature section 10 extends out from bristle beam protrusion 9 on both sides. The top of bristle beam protrusion in aligned with the ridge 14 on bristle beam section backside—An area of alignment 15 is detailed to keep alignment and height contained when engaged with main beam parallel arms 17 for streamline look and feel.

FIG. 2B also details better understanding of bristle head depth from the side view. A depth of 3.52 mm in relationship to the overall bristle head section thickness of 4.75 mm.

Figure 2C:
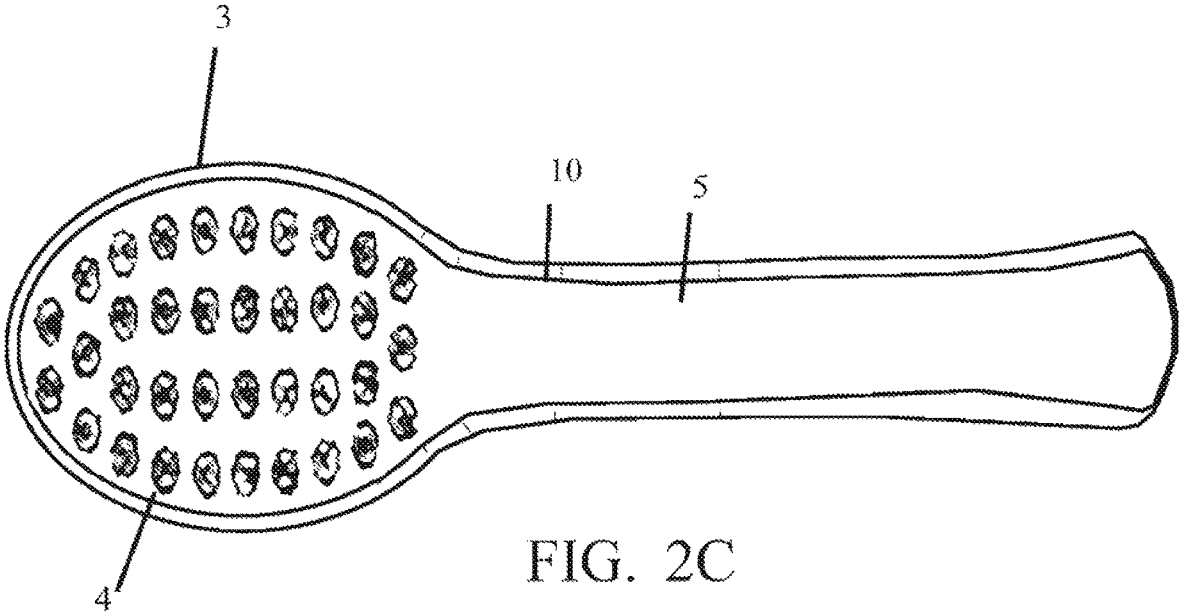
FIG. 2C is a top view of the head section of the force sensitive toothbrush

FIG. 2C in detail is the bristle beam 5 which encompasses bristle head 3. Bristle head 3 consists of 36 bristle holes 4 for bristle insertion. Pivot movement is subject only the bristle head beam 5 at the bristle beam 5 feature 10 positioned on the bristle beam 5. The bristle beam 5 pivots away from the handle section 1 at the pivot area 16 from FIG. 3A. The pivoting distance is not set by any specific added feature. To further explain, there is no set angle in which the bristle beam 5 will stop due to design features. Our concern was that, if a feature limiting the pivot existed, then increased Newtons could be applied by false claims.

Figure 3A:
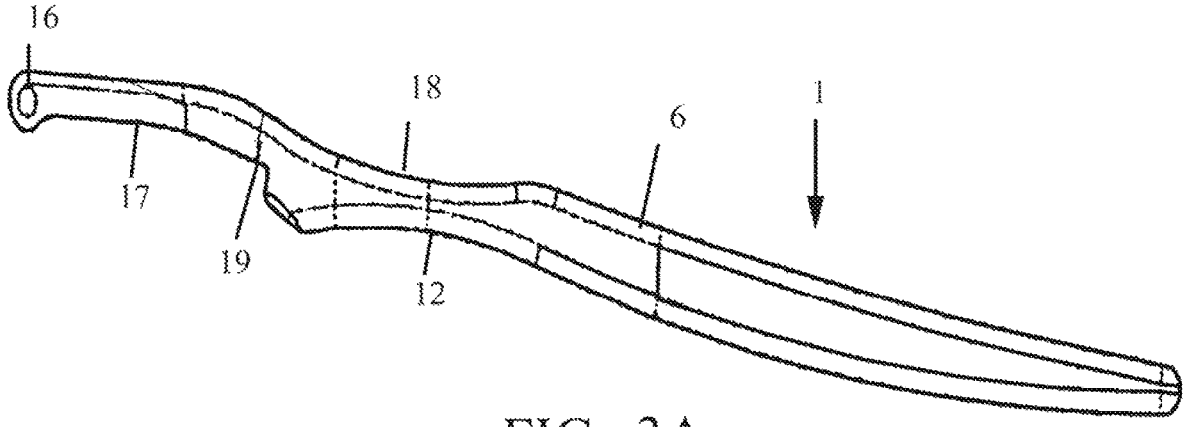
FIG. 3A is a side view of the handle section of the force sensitive toothbrush

FIG. 3A is a side view of main beam 6 which is part of the main handle section 1. Main beam 6 contains thumb area 18 and continues through the main beam parallel arms 17 to the main beam point of pivot 16. The diameter of the main beam point of pivot holes are 2.40 mm+/−0.1 mm to receive feature 10 as shown on FIG. 2A and FIG. 2B. the underside of the main beam 6 has a magnet 19 which is 32.12 mm from the center of the hole of the main beam point of pivot 16. The magnet 19 engages and releases from bristle beam section 5 magnet 11 when predetermined forces causes release and reset manually. Index finger rest 12 on the underside of the main beam 6. The area opposite the pivot section 2 is the area for the hand and remaining fingers to clasp/hold to control force sensitive toothbrush.

Figure 3B:
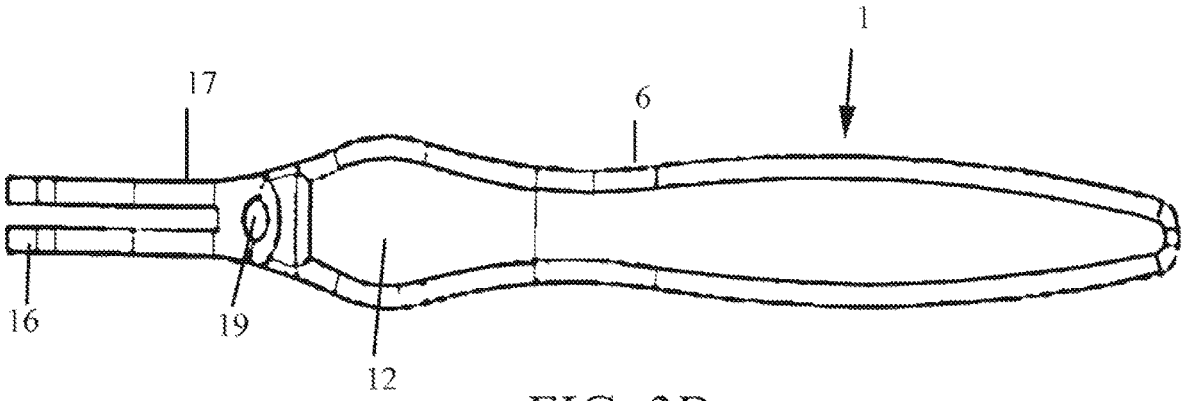
FIG. 3B is a top view of the handle section of the force sensitive toothbrush

FIG. 3B is the bottom side of the main beam 6. It better details the main beam parallel arms 17 and magnet 19. It provides detail of the index finger placement 12.

Figure 4:
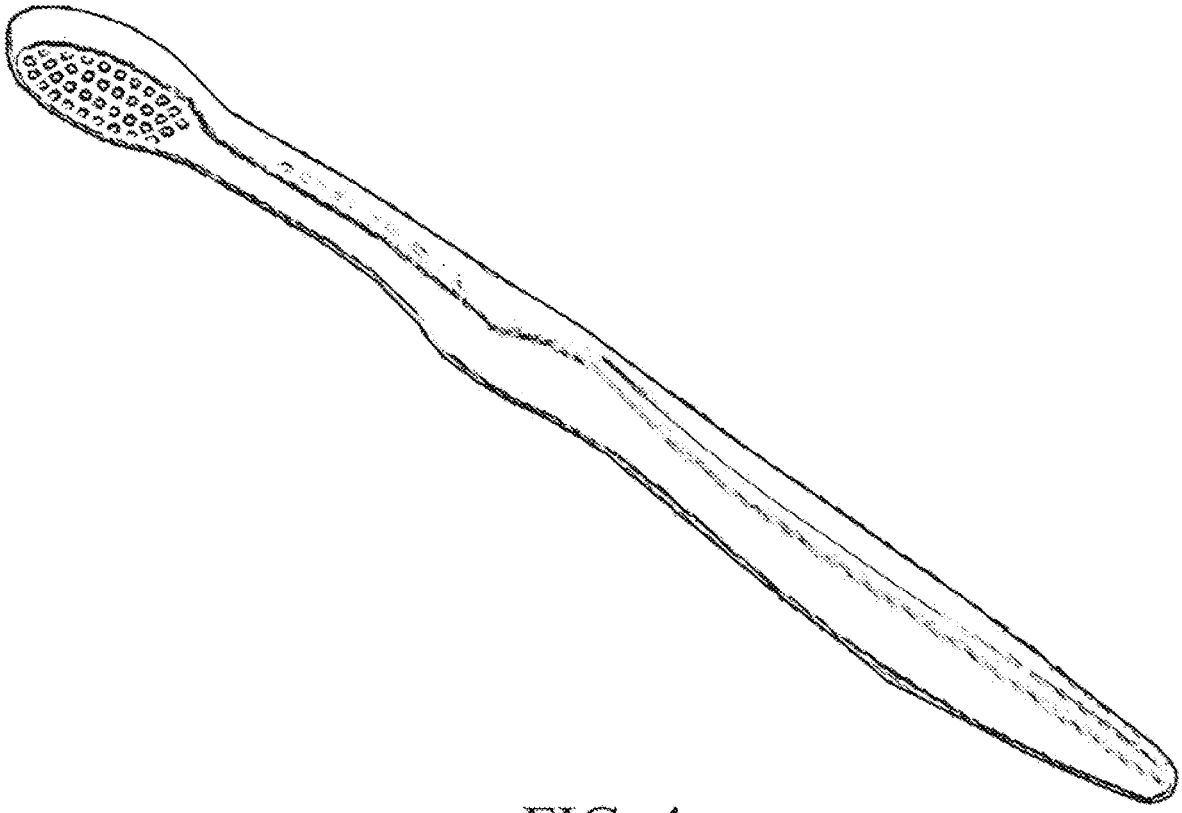
FIG. 4 is an isometric view of the force sensitive toothbrush

FIG. 4 is the isometric view of the force sensitive toothbrush. The isometric puts in perspective the full design of the force sensitive toothbrush in the closed position. The closed position is when main beam 6 is connected to bristle beam 5 by means of the magnet 11 set on the top side of bristle beam section 5 is in full contact with magnet 11 on the bottom side of main beam 6.

What is claimed is:

1. A force sensitive toothbrush for providing a tactile and visual indication to a user when brushing force is excess, comprising:

a bristle beam section including a bristle head having a face bearing a plurality of bristles for cleaning a user's teeth and gums, a backside opposite said face, a peripheral sidewall adjoining said face and backside, a bristle beam extending sidelong from said bristle head and flaring outward to a distal end, a raised rib extending along said bristle beam, a pair of opposing hinge pins protruding sideward from said bristle beam at said distal end, and a magnet embedded in said bristle beam proximate said distal end;

a handle section configured at one end for gripping by said user's hand and branching to a pair of parallel-extending arms at an opposing end, said pair of arms defined by a pair of opposing distal pivot holes, and a magnet embedded in said handle section;

the bristle beam hinge pins being hingedly-engaged in the pivot holes of said handle section, and said bristle beam protrusion being configured to slide between the pair of arms of the handle section;

whereupon the bristle beam magnet magnetically-engages to the handle section magnet, and disengages when a separating release force within a range of 0.5 to 1.5 Newtons is applied there between.

2. The force sensitive toothbrush of claim 1 wherein the backside of said bristle head seats the user's index finger.

3. The force sensitive toothbrush of claim 1 wherein said bristle beam seats flush against said handle section with the bristle beam magnet magnetically-engaged to the handle section magnet thereby exposing a backside of said bristle beam section, and an indent on said backside of said bristle beam section allows said force sensitive toothbrush to be used beyond the predetermined brushing force range from 1-3 Newtons to brush said user's tongue.

4. The force sensitive toothbrush of claim 1 wherein said backside of said bristle beam section allows said force sensitive toothbrush to be used beyond the range from 1-3 Newtons to brush said user's tongue.

* * * * *